US005310355A

United States Patent [19]

Dannatt

[11] Patent Number: 5,310,355

[45] Date of Patent: May 10, 1994

[54] STRIP LIGHTING ASSEMBLY

[76] Inventor: Irmgard Dannatt, 5018 Tutle Cove Rd., Manhattan, Kans. 66512

[21] Appl. No.: 28,291

[22] Filed: Mar. 9, 1993

[51] Int. Cl.[5] ..... H01R 25/16

[52] U.S. Cl. ..... 439/110; 439/211; 362/249

[58] Field of Search ..... 439/207-211, 439/214, 216, 110-112, 426; 362/249; 174/117 FF

[56] References Cited

U.S. PATENT DOCUMENTS

| | | | |
|---|---|---|---|
| Re. 11,970 | 2/1902 | Greil et al. | 439/426 |
| 1,067,024 | 7/1913 | Hall et al. | 439/426 |
| 1,955,531 | 4/1934 | Christopher, Jr. | 439/120 |
| 2,042,105 | 5/1936 | Kelley | 439/32 |
| 2,666,907 | 1/1954 | Hensley, Jr. | 439/210 |
| 2,749,382 | 6/1956 | Lockard | 174/71 |
| 3,007,131 | 10/1961 | Dahlgren et al. | 439/492 |
| 3,500,036 | 3/1970 | Szentveri | 439/111 |
| 3,524,921 | 8/1970 | Wolf | 174/70 |
| 3,894,225 | 7/1975 | Chao | 362/249 |
| 4,143,931 | 3/1979 | Skare et al. | 439/215 |
| 4,173,035 | 10/1979 | Hoyt | 362/249 |
| 4,514,791 | 4/1985 | Tokieda | 362/249 |
| 4,744,766 | 5/1988 | Hall et al. | 439/110 |
| 4,920,467 | 4/1990 | Honsberger | 362/226 |
| 4,934,956 | 6/1990 | Conti | 439/492 |
| 5,010,463 | 4/1991 | Ross | 362/253 |

FOREIGN PATENT DOCUMENTS

| | | | |
|---|---|---|---|
| 2510077 | 9/1976 | Fed. Rep. of Germany | 439/210 |

*Primary Examiner*—Gary F. Paumen
*Attorney, Agent, or Firm*—Linda Flewellen Gould

[57] ABSTRACT

Strip lighting assemblies are useful for supporting and illuminating light bulbs in a variety of contexts, including bookshelves and display cases, while maintaining the lighting hardware and wiring in relative obscurity, to avoid detracting from the display being illuminated. A strip lighting assembly is provided which arranges two conductive strips in vertical fashion, to achieve a relatively narrow and nonobtrusive assembly. A special socket design is also provided, which may accommodate a variety of light bulbs or power chords. The socket includes a movable insert which may be adjusted to alter the size of the receptacles of the socket, increasing the receptacle area to accommodate larger light bulb terminals or power chords, and decreasing the receptacle area to snugly fit smaller light bulb terminals.

15 Claims, 4 Drawing Sheets

STRIP LIGHTING ASSEMBLY

BACKGROUND OF THE INVENTION

1. Technical Field

This invention pertains to a strip lighting assembly for holding and illuminating a variety of light bulbs.

2. Background Art

Strip lighting assemblies are frequently used to provide illumination for displays, bookcases, shelving, and other areas to provide bright light while maintaining light bulbs and wiring in relative obscurity. Ideally, such assemblies should be easy to mount, and provide for a variety of choices in terms of types and spacing of light bulbs. Furthermore, it may be desirable to keep such an assembly to a relatively narrow width, so that the assembly itself is not as noticeable as the objects being illuminated and displayed.

A variety of strip lighting assemblies are known in the prior art. For example, U.S. Pat. No. 4,934,956 to Conti describes a lighting strip in which a pair of socket elements are electrically connected to dual conductors, which conductors may be folded to create a narrow lighting strip. Other strip electrical assemblies designed to hold and provide electric current to light bulbs or other electrical appliances are disclosed by U.S. Pat. No. 3,524,921 to Wolf, U.S. Pat. No. 2,042,105 to Kelley, U.S. Pat. No. 1,955,531 to Christopher, U.S. Pat. No. 4,173,035 to Hoyt, U.S. Pat. No. 4,514,791 to Tokieda, U.S. Pat. No. 3,894,225 to Chao, U.S. Pat. No. 2,666,907 to Hensley, and U.S. Pat. No. 3,500,036 to Szentveri.

Similarly, a number of wiring assemblies are known in the prior art, for providing electricity to a remote light or other appliance while keeping the wiring relatively obscure, such as U.S. Pat. No. 3,524,921 to Wolf, U.S. Pat. No. 4,143,931 to Skare et al., and U.S. Pat. No. 2,749,382 to Lockard.

The invention claimed herein represents an improvement over the strip lighting assemblies known in the prior art, in terms of its narrow, unobtrusive construction, and in terms of the variety of electrical contacts that may be easily made without adaptors. The narrow construction is in part related to vertical placement of conductors within the assembly. Specific mechanisms using vertically arranged conductive paths are known in the prior art for particular applications, such as U.S. Pat. No. 5,010,463 to Ross for an electrified bulletin board, which allows illumination of specially designed push-pin bulbs. Similarly, U.S. Pat. No. 4,920,467 to Honsberger teaches the use of plural conductive layers to support illuminating devices which extend to varying depths in that base. U.S. Pat. No. 4,744,766 to Hall et al. discloses a low voltage electrical distribution system using a pair of planar conductive layers for mounting a jack plug. U.S. Pat. No. 3,007,131 to Dahlgren et al. teaches an electrical connector for connecting wide, printed circuit cables having more than one layer of conductors. While these devices are useful for their intended purpose, they are not appropriate for situations in which a relatively narrow strip lighting assembly is desirable.

While each of these mechanisms known in the prior art is useful for its intended purpose, a strip lighting assembly is needed which is relatively narrow, so as to permit the assembly to be as unnoticeable as possible, while permitting a variety of types of light bulbs to be easily mounted and illuminated, and permitting flexible options for supplying current to the assembly.

DISCLOSURE OF THE INVENTION

Summary of the Invention

An object of this invention is to provide a relatively narrow strip lighting assembly to hold and illuminate light bulbs in an inconspicuous manner.

Another object of this invention is to provide a strip lighting assembly on which a variety of light bulbs may be mounted, with no more than a simple screw adjustment.

Yet another object of this invention is to provide a strip lighting assembly to which power leads may be connected on the upper side of the assembly, without having to fit the power leads beneath or to the side of the installed assembly, with no more than a simple screw adjustment.

The lighting assembly claimed herein supports and illuminates light bulbs of a type having no base but just consisting of a bulb with a filament and appropriate wiring inside, and two wire terminals protruding therefrom. Such bulbs are commercially available in a variety of sizes and wattages. One of the advantages of this invention is that the strip lighting assembly claimed herein can support more than one size of such bulbs.

The strip lighting assembly of this invention comprises an insulated band, first and second conductive strips, an intermediate insulating strip separating the first and second conductive strips from each other, and more than one socket for holding the light bulbs. Various configurations of the insulated band and conductive strips are possible. For example, the conductive strips may be aligned side by side, with the intermediate insulating strip in between, so that the top side of each conductive strip is attached to the under side of the insulated band. A more narrow construction of the lighting strip is made possible by aligning the conductive strips vertically.

Such a vertical configuration may effectively decrease the width of the lighting strip from the side-by-side conductive strip arrangement by fifty percent. The narrow width made possible by such a configuration is advantageous since the lighting strip is made less conspicuous thereby.

In the vertical conductive strip configuration, each conductive strip may conveniently be perforated at continuous and preset intervals with aperture pairs. The apertures in each pair are located so that the distance between the centers of each aperture is equal to the distance between terminals of sockets to be mounted on the insulated band. Each aperture pair comprises one aperture which is larger than the other. The smaller of each aperture pair has a diameter which will snugly receive and contact a socket terminal. The larger of each aperture pair has a diameter which is too large to contact a socket terminal when that terminal is inserted in the middle of the larger aperture.

The two conductive strips are arranged, in the vertical conductive strip configuration, so that the larger apertures in each aperture pair in the top conductive strip are directly above the smaller apertures of each aperture pair in the bottom conductive strip. Similarly, the smaller aperture of each aperture pair in the top conductive strip is directly above a larger aperture of an aperture pair in the bottom conductive strip. In this manner, each terminal of a socket mounted on the light assembly will contact only the top conductive strip or the bottom conductive strip, while the other terminal of that same socket will contact only the conductive strip not contacted by the first terminal.

A socket may be advantageously mounted on the insulated band, at any location which is directly above an aperture pair in the vertically arranged conductive strips. Each socket comprises a first and second conductive receptacle, separated from each other. For example, the conductive receptacles on a socket may be separated from each other by an insulating divider. Each receptacle may have a terminal protruding from the base of that receptacle suitable for inserting in the apertures of the conductive strips. The socket may be conveniently attached to the lighting assembly by a variety of mechanisms, including solder, a screw, or a rivet.

A particularly versatile socket design includes a movable insert placed inside each conductive receptacle, which may be moved within the receptacle to increase or decrease the size of the area within the receptacle. In this manner, the receptacle may be made small enough to snugly support a small light bulb, or may be increased in size to accommodate a larger light bulb. Furthermore, the insert may be adjusted to enlarge the receptacle area sufficiently to allow power leads to be inserted into and snugly held by the receptacles. As a result, power leads may be connected to the light assembly at any location where a socket is located, without requiring specialized attachment mechanisms. Furthermore, such power leads may be attached to the light assembly from the top side of the assembly, eliminating the need to direct a power chord to a particular location on the assembly which may be underneath or to the side of the mounted assembly in a position which is difficult to reach.

The movable insert may conveniently comprise a flexible band, one end of the band being attached to the socket, and the other end of the band being inserted into the receptacle without being attached. A hole formed in the side of the socket, and extending into the receptacle, permits a screw to be inserted through the socket to contact the movable insert. Thus, when such a screw is tightened into the socket, the insert will be pushed toward the middle of the receptale, restricting the space available within the receptacle to receive a light bulb terminal or power chord. When the screw is loosened, the insert may move toward the side of the receptacle, providing more room to accommodate a larger terminal or power chord. A simple adjustment of the screw on each receptacle permits easy mounting of light bulbs or power chords, and a simple mechanism for tightening the grip of the receptacle on an inserted bulb or chord.

The novel features that are considered characteristic of the invention are set forth with particularity in the claims. The invention itself, both as to its construction and its method of operation, together with additional objects and advantages thereof, will best be understood from the description of specific embodiments which follows, when read in conjunction with the accompanying drawings.

2.2 BRIEF DESCRIPTION OF THE DRAWINGS

FIG. 1 is an exploded perspective view of a strip lighting assembly according to the present invention.

FIG. 2*a* is a top perspective view of a socket suitable for use with the strip lighting assembly of the present invention.

FIG. 2*b* is a bottom perspective view of a socket suitable for use with the strip lighting assembly of the present invention.

DETAILED DESCRIPTION OF THE PREFERRED EMBODIMENT

Figure 1:
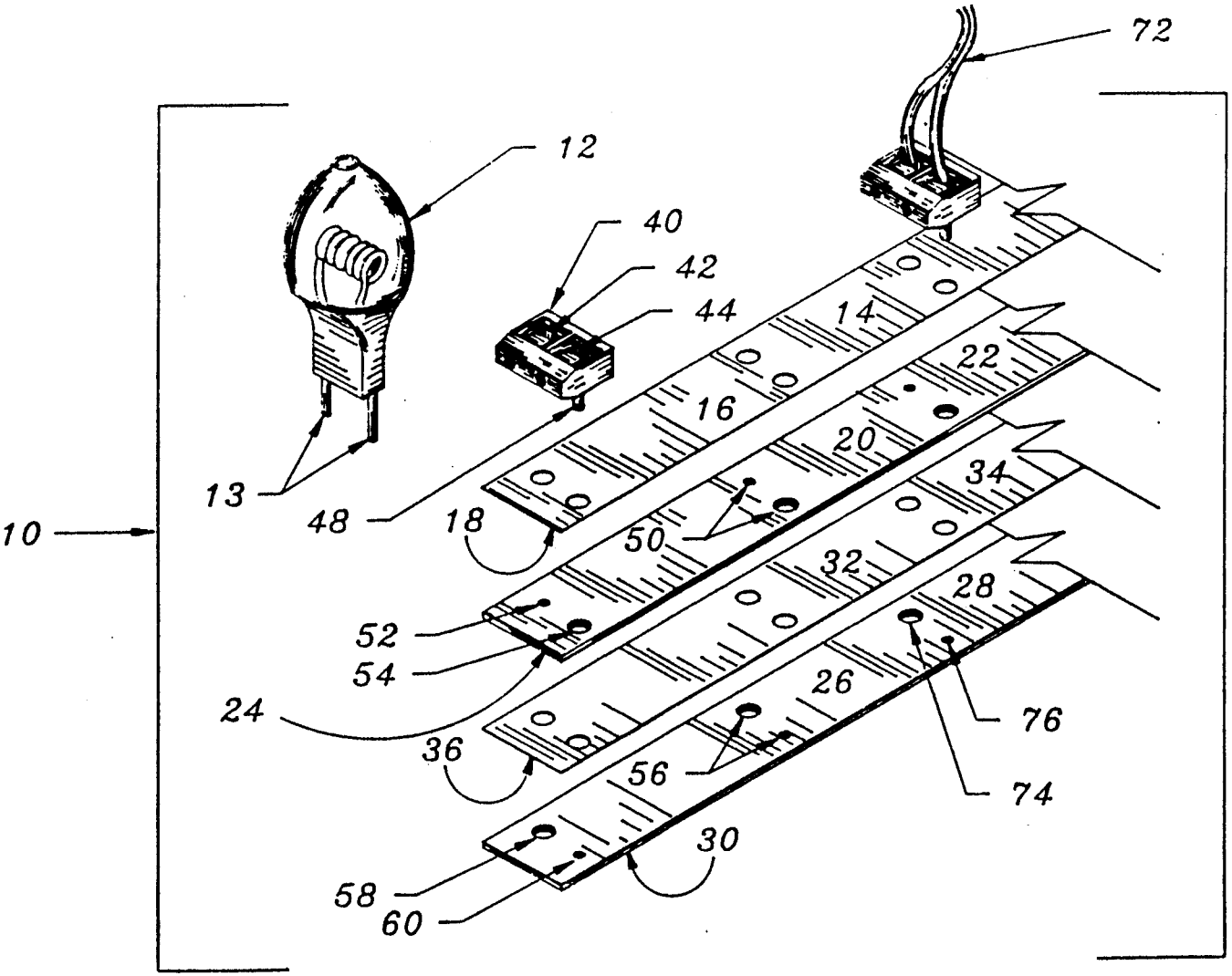

The strip lighting assembly of the present invention can be better understood by reference to FIG. 1. A light assembly 10 is provided which may support and illuminate a variety of light bulbs 12, each such light bulb having a pair of terminals 13. The light assembly 10 includes dual conductive strips 20,26, which may be arranged side-by-side, vertically as shown in FIG. 1, or in some other parallel configuration. The conductive strips 20,26 are separated from each other by an insulating strip 32. Furthermore, an insulated band 14 serves to support a plurality of sockets 40, while separating the sockets 40 from the conductive strips 20,26.

Figure 2B:
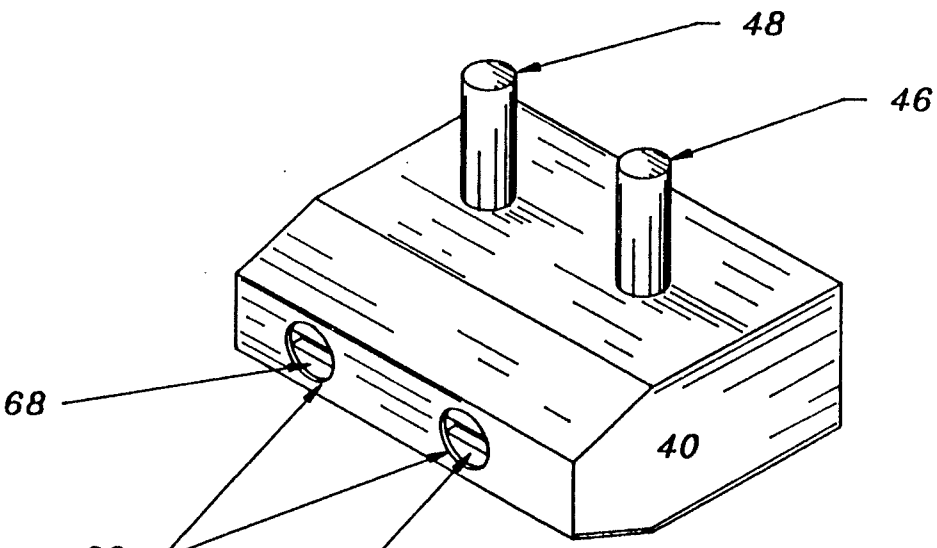
Figure 2A:
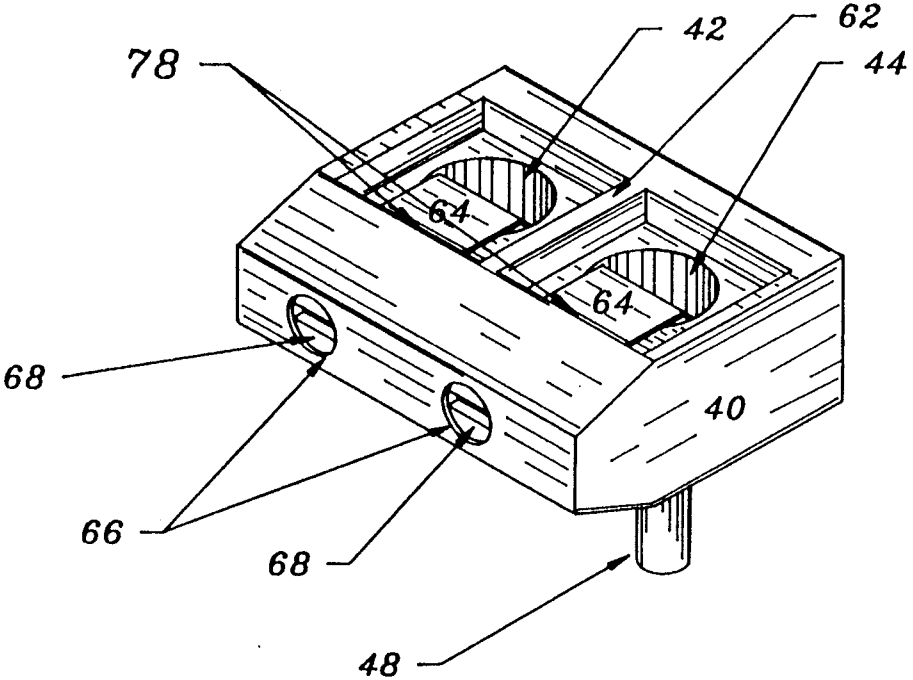
Figures 4, 5:
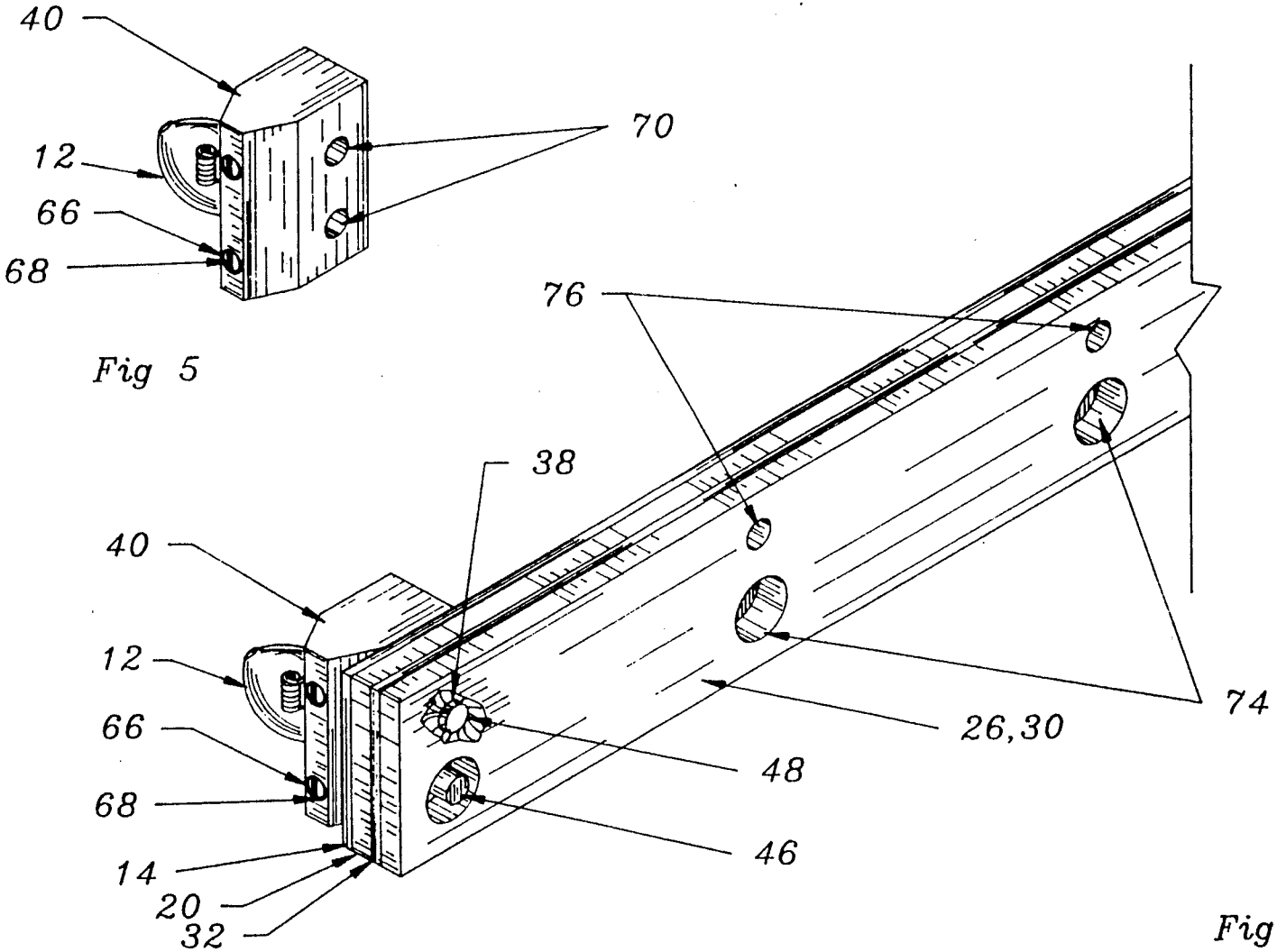
FIG. 4 is a bottom and side perspective view of the strip lighting assembly of the present invention.
FIG. 5 is a bottom and side perspective view of a socket suitable for use with the strip lighting assembly of the present invention.

Each socket 40 conveniently comprises a pair of conductive receptacles 42,44, as is best shown in FIG. 2*a*. Each receptacle 42,44 may have a terminal 46,48 protruding from the receptacle 42,44, as shown in FIG. 2*b*, which terminal extends through the insulated band 14, to contact the conductive strips 20,26 in a manner which provides for a flow of electric current to any light bulb 12 inserted in the sockets 40. Alternatively, as shown in FIG. 5, each socket may be provided with a pair of fastener receiving holes 70, permitting fastener rivets or screws (not shown) to be used to attach the socket 40 to the conductive strips 20,26, thereby forming a conductive path across the fastener from each receptacle 42,44 to one of the conductive strips 20,26. The receptacles 42,44 in each socket 40 may be conveniently separated from each other by an insulating divider 62.

A preferred embodiment shown in FIG. 2*a* includes an adjusting means to enlarge or decrease the area within each receptacle 42,44 of a socket 40. As a result of this adjusting means, light bulbs 12 of a variety of sizes may be inserted into the sockets 40. Furthermore, power chords 72 may be inserted in any of the sockets 40, as show in FIG. 1, permitting power chords to be simply routed and connected to the light assembly 10, at any place where a socket 40 is located. To enable each socket 40 to support a variety of light bulbs and even power chords, the adjusting means may include a movable insert 64, inserted in each receptacle 42,44. The movable insert 64 may be constructed of either conductive or insulative materials. The movable insert 64 may comprise a flexible strip, as shown in FIG. 2*a*. This flexible strip 64 is attached at one end 78 to the socket 40, at a point of attachment that may be exterior to or inside the relevant receptacle 42,44. The other end (not shown) of the movable insert 64 is inserted into the receptacle 42,44, but is not attached to the receptacle 42,44 or the socket 40, allowing that end of the movable insert 64 to be freely moved within the receptacle 42,44. A screw receiving hole 66 is formed in the socket 40 and the receptacle 42,44, to permit an adjusting screw 68 to be inserted into the socket 40 to engage the insert 64 which is inside the receptacle 42,44. Thus, the screw 68 may simply be tightened to move the insert 64 toward the center of the receptacle 42,44, effectively decreasing the area inside the receptacle 42,44 and allowing for a snug fit of relatively small light bulb terminals 13. On the other hand, the screw 68 may easily be loosened to allow the insert 64 to move toward a side of the receptacle 42,44, increasing the effective area within the receptacle 42,44, to accommodate insertion of a larger light bulb terminal 13 or a power chord 72.

Figure 3:
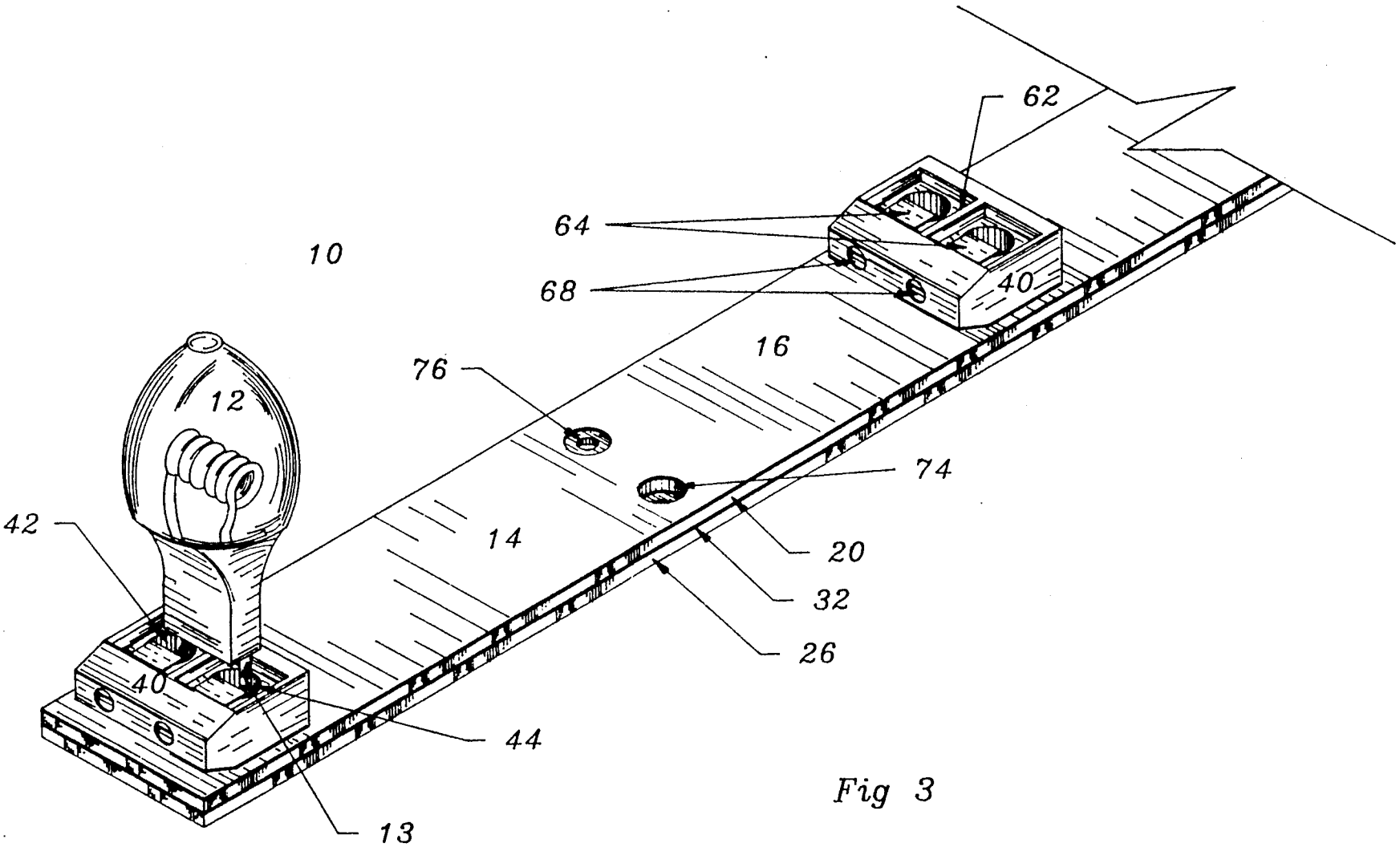
FIG. 3 is a top perspective view of the strip lighting assembly of the present invention.

In order to achieve a relatively narrow and unobtrusive assembly, it is advantageous to arrange the conductive strips 20,26 in a vertical array, as shown in FIG. 3. The first conductive strip 20 is aligned above and parallel to the second conductive strip 26, separated by the intermediate insulating strip 32. Thus, as shown in FIG. 1, the upper side 22 of the first conductive strip 20 is connected to the lower side 18 of the insulated band 14, while the lower side 24 of the first conductive strip 20 is attached to the upper side 34 of the insulating strip 32. Similarly, the upper side 28 of the second conductive strip 26 is attached to the lower side 36 of the second conductive strip 26. It is advisable to cover the lower side 30 of the second conductive strip 26 with some insulating material (not shown) to avoid possible contact with other conductive materials. At the top of the resulting vertical array, sockets 40 are attached to the upper side 16 of the insulated band 14.

Each conductive strip 20,26 is conveniently perforated with a plurality of aperture pairs 50,56, with each pair aligned to receive a first and second terminal 46,48 extending from the first and second conductive receptacles 42,44 of a socket 40. Thus, the distance between the centers of the apertures in each aperture pair 50,56 corresponds to the distance between the first and second terminals 46,48 of each socket 40. Alternatively, each aperture pair 50,56 may receive a fastener (not shown) inserted into the bottom 30 of the vertically array, which fastener makes electrical contact with a terminal 13 of the bulb 12. Each aperture pair 50,56 contains one aperture 76 which is of a size which will snugly receive and make contact with a terminal 46,48 extending from a socket 40, or with a fastener in contact with a terminal 13 of the light bulb 12. The other aperture 74 in each aperture pair 50,56 is of a size which is large enough to avoid contact with a terminal 46,48 or a fastener (not shown) inserted into that aperture 74. The aperture pairs 50 on the top conductive strip 20 are arranged and aligned with respect to the aperture pairs 56 on the second conductive strip 26 so that a large aperture 74 in the first conductive strips 20 is aligned above a small aperture 76 in the second conductive strip 26, and each small aperture 76 in the first conductive strip 20 is aligned above a large aperture 76 in the second conductive strip 26. In this manner, a first terminal 46 protruding from a socket 40 will contact only one of the conductive strips 20,26, while a second terminal 48 protruding from that same socket 40 will contact the conductive strip 20,26 which is not contacted by the first terminal 46.

The conductive strips 20,26 can be conveniently mass produced, since each first conductive strip 20 has aperture pairs 50 which are the same size and distance from one another as the aperture pairs 56 in the second conductive strip 26. In forming the vertically arrayed light assembly, the first conductive strip 20 is simply inverted with respect to the second conductive strip 26. As a result, if a first top aperture 52 in the first conductive strip 20 is a small aperture 76, then the first bottom aperture 58 in the second conductive strip 26 will be a large aperture 74. Similarly, mating the identical conductive strips 20,26 in this fashion causes each second top aperture 54 to be a large aperture 74, aligned above a second bottom aperture 60 which is a small aperture 76.

A variety of methods of attaching the various components of this vertical array are possible. For example, the conductive strips 20,26, intermediate insulating strip 32, and insulated band 14 may be connected to each other by solder spots 38, as shown in FIG. 4. Solder may be conveniently applied to a terminal 46,48 protruding from a socket 40, when that socket 40 has been positioned in contact with the insulated band 14 above a top aperture pair 50 in the first conductive strip 20 and a bottom aperture pair 56 in the second conductive strip 26. When the socket 40 is so positioned, each terminal 46,48 protruding from the socket receptacles 42,44 is inserted in a large aperture 74 on either the first conductive strip 20 or the second conductive strip 26, and inserted in a small aperture 76 on the other conductive strip 20,26. The large aperture 74 is sufficiently large to avoid contact with the solder spot 38, so that the solder spot 38 attaches the terminal 46,48 to only one of the conductive strips 20,26, at the point the terminal 46,48 is inserted in the small aperture 76.

Other methods of connecting the sockets 40 to the other components of the light assembly 10 are possible. For example, an attaching fastener such as a screw or rivet (not shown) may be inserted through the lower side 30 of the second conductive strip 26, into one of the apertures of the bottom aperture pair 56, then into one of the apertures in a top aperture pair 50, through the insulated band 14, and finally into the socket 40, so that the attaching fastener contacts one of the conductive strips 20,26, via a small aperture 76, and contacts one of the receptacles 42,44. However, the fastener does not contact the other conductive strip 20,26, since the fastener is inserted in the middle of a large aperture 74 in that other conductive strip 20,26. In this embodiment, there is no need to have a terminal 46,48 protruding from the socket 40, as shown in FIG. 5.

A glass enclosure (not shown) may be advantageously mounted over each light bulb 12 and socket 40, as a safety percaution, to prevent burning any person or thing might otherwise come into contact with the light bulb 12.

The invention has been described in detail with particular reference to preferred embodiments thereof. As will be apparent to those skilled in the art in the light of the accompanying disclosure, many alterations, substitutions, modifications, and variations are possible in the practice of the invention without departing from the spirit and scope of the invention.

I claim:

1. A light assembly for holding and illuminating a plurality of light bulbs, comprising:

a. an elongated insulated band formed of insulating material having an upper side and a lower side, b. a first conductive strip having an upper side and a lower side, said first conductive strip being aligned parallel to said insulated band, c. a second conductive strip having an upper side and a lower side, said second conductive strip being aligned parallel to said insulated band, d. an intermediate insulating strip having an upper side and a lower side, said intermediate insulating strip being attached to said first conductive strip and to said second conductive strip to prevent electrical contact between said first conductive strip and said second conductive strip, e. connecting means for connecting said first conductive strip, said second conductive strip, said intermediate insulating strip, and said insulated band, f. a plurality of sockets connected to said upper side of said insulated band, each of said sockets having a first and second conductive receptacle formed therein, said first and second receptacles being separated from each other, each of said first receptacles having a first terminal protruding therefrom to make electrical contact with said first conductive strip and each of said second receptacles having a second terminal protruding therefrom to make electrical contact with said second conductive strip, and g. adjusting means for restricting or expanding at least one of said receptacles formed in at least one of said sockets.

2. A light assembly as described in claim 1, wherein:

a. said upper side of said first conductive strip is connected directly to said lower side of said insulated band, b. said upper side of said intermediate insulating strip is connected directly to said lower side of said first conductive strip, and c. said upper side of said second conductive strip is connected directly to said lower side of said intermediate insulating strip.

3. A light assembly as described in claim 2, wherein said first conductive strip is perforated with a plurality of top aperture pairs, each of said top aperture pairs comprising a first top aperture and a second top aperture, wherein said first top aperture and said second top aperture are aligned so that said first terminal protruding from said first receptacle of one of said sockets may be inserted into said first top aperture, and said second terminal protruding from said second receptacle of said socket may be inserted into said second top aperture.

4. A light assembly as described in claim 3, wherein said second conductive strip is perforated with a plurality of bottom aperture pairs, each of said bottom aperture pairs comprising a first bottom aperture and a second bottom aperture, wherein said first bottom aperture and said second bottom aperture are aligned so that said first terminal protruding from said first receptacle of one of said sockets may be inserted into said first bottom aperture, and said second terminal protruding from said second receptacle of said socket may be inserted into said second bottom aperture.

5. A light assembly as described in claim 4, wherein each of said first top apertures is a predetermined size which permits said first terminal protruding from said first receptacle of one of said sockets to contact said first conductive strip when said first terminal is inserted in said first top aperture.

6. A light assembly as described in claim 5, wherein each of said second top apertures is a predetermined size which permits said second terminal protruding from said second receptacle of one of said sockets to avoid contact with said first conductive strip when said second terminal is inserted in said second top aperture.

7. A light assembly as described in claim 6, wherein each of said second bottom apertures is a predetermined size which permits said second terminal protruding from said second receptacle of one of said sockets to contact said second conductive strip when said second terminal is inserted in said second bottom aperture.

8. A light assembly as described in claim 7, wherein each of said first bottom apertures is a predetermined size which permits said first terminal protruding from said first receptacle of one of said sockets to avoid contact with said second conductive strip when said first terminal is inserted in said first bottom aperture.

9. A light fixture as described in claim 8, wherein said connecting means further comprises using solder to connect said first terminal to said first top aperture, and to connect said second terminal to said second bottom aperture.

10. A light assembly as described in claim 1, wherein said first and second receptacles are separated from each other by an insulating divider.

11. A light assembly as described in claim 1, wherein said adjusting means further comprises:

a. a movable insert placed inside said receptacle, b. a screw receiving hole formed in said socket and said receptacle, aligned so that an adjusting screw inserted into said screw receiving hole will contact said movable insert when said adjusting screw is tightened, c. an adjusting screw inserted into said screw receiving hole so that tightening said screw results in pushing said movable insert in a manner that restricts said receptacle.

12. A light assembly as described in claim 11, wherein said movable insert further comprises a flexible band, one end of said band being attached to said socket, and the other end of said band being inserted into said receptacle without being attached to said socket.

13. A light assembly for holding and illuminating a plurality of light bulbs, comprising:

a. an elongated insulated band formed of insulating material having an upper side and a lower side, b. a first conductive strip having an upper side and a lower side, said first conductive strip being aligned parallel to said insulated band, c. a second conductive strip having an upper side and a lower side, said second conductive strip being aligned parallel to said insulated band, d. an intermediate insulating strip having an upper side and a lower side, said intermediate insulating strip being attached to said first conductive strip and to said second conductive strip to prevent electrical contact between said first conductive strip and second said conductive strip, e. a plurality of sockets connected to said upper side of said insulated band, each of said sockets having a first and second conductive receptacle formed therein, said first and second receptacles being separated from each other, f. conductive first fastener inserted through and contacting said first conductive strip, inserted through said insulated band, and inserted into said first conductive receptacle, in a manner that connects said first conductive strip, said insulated band, and said socket, g. conductive second fastener inserted through and contacting said second conductive strip, inserted through said insulated band, and inserted into said second conductive receptacle, in a manner that connects said second conductive strip, said insulated band, and said socket, and h. adjusting means for restricting or expanding at least one of said receptacles formed in at least one of said sockets.

14. A light assembly as described in claim 13, wherein said adjusting means further comprises:

a. a movable insert placed inside said receptacle, b. a screw receiving hole formed in said socket and said receptacle, aligned so that an adjusting screw inserted into said screw receiving hole will contact said movable insert when said adjusting screw is tightened, c. an adjusting screw inserted into said screw receiving hole so that tightening said screw results in pushing said movable insert in a manner that restricts said receptacle.

15. A light assembly as described in claim 14, wherein said movable insert further comprises a flexible band, one end of said band being attached to said socket, and the other end of said band being inserted into said receptacle without being attached to said socket.

* * * * *